US005437134A

United States Patent [19]

Donnelly

[11] Patent Number: 5,437,134

[45] Date of Patent: Aug. 1, 1995

[54] COLLAPSIBLE SECURITY GRILLE

[76] Inventor: Francis M. Donnelly, c/o FAS, Baldoyle IndustrialEstate, Baldoyle, Dublin 13, Ireland

[21] Appl. No.: 99,172

[22] Filed: Jul. 29, 1993

[30] Foreign Application Priority Data

Jul. 29, 1992 [AU] Australia ..... PL3826

[51] Int. Cl.[6] ..... E06B 9/06

[52] U.S. Cl. ..... 52/507; 52/106; 49/55; 160/161; 160/373; 403/396

[58] Field of Search ..... 52/19, 106, 507, 664, 52/456, 720, 711; 160/372–376, 160, 161, 159, 162; 403/400, 396, 381, 116, 364; 49/50, 55, 56, 57

[56] References Cited

U.S. PATENT DOCUMENTS

| | | | |
|---|---|---|---|
| 1,215,462 | 2/1917 | Agee | 49/55 |
| 1,557,511 | 10/1925 | Wieland | 160/162 |
| 1,571,661 | 2/1926 | Descoteau | 160/373 |
| 2,001,181 | 5/1935 | Burcham | 49/55 |
| 3,314,469 | 4/1977 | Kaufman et al. | 160/159 |
| 3,338,289 | 8/1967 | Catalono | 160/161 |
| 3,506,056 | 4/1970 | Quinones et al. | 160/161 |
| 3,617,078 | 11/1971 | Valukonis | 403/396 |
| 4,649,679 | 3/1987 | Arens | 403/364 |

*Primary Examiner*—Carl D. Friedman
*Assistant Examiner*—Winnie Yip
*Attorney, Agent, or Firm*—Chernoff, Vilhauer, McClung & Stenzel

[57] ABSTRACT

A collapsible security grille is provided comprising two conventional face-to-face sets of rigid grille bars (2, 9) pivotally interconnected at their intersections, wherein all the pivotal connectors (4) are uniformly and non-adjustably spaced apart along their respective grille bars in one said sets, but are free, as far as the second set is concerned, to undergo small sliding displacements along the grille bars of that set. In this way the stresses that ordinarily lead to jamming, jerky action and noise are automatically compensated at the point and instant of their origin. It is preferred that the pivotal connectors around the periphery of the second set are likewise non-adjustably spaced apart, so that every such connector at a grille bar meeting point (6) (as distinct from a crossing point 8) is spaced from both of the two next adjacent crossing-point connectors (8). A spacer member (7) suitable for this purpose can be made integral with a pivotal connector, and can be made in two parts (28, 31; 29 30) for length adjustment prior to use. The length of the spacer in use determines the pitch of the grille.

8 Claims, 5 Drawing Sheets

11
4
27
33
26
31
5
34
35
36
l'
28

7
33
35

39
29
7
38
30

34
39a
39
35
36
l
38

2,9

3,10

COLLAPSIBLE SECURITY GRILLE

BACKGROUND OF THE INVENTION

This invention relates to a collapsible security grille for screening and freeing at will a doorway, a window reveal, a skylight, the space above a bar or counter, or any other passable opening to which it is desired to deny access at certain times, but not at others.

A known construction of expanding and collapsing security grille comprises, supported in a non-collapsible frame, an array of grille bars consisting of a first set of rigid elongate parallel uniformly spaced-apart grille bars, and a second, similar set in close face-to-face proximity to the first, wherein the grille bars of one set are inclined and disposed with respect to those of the other set to produce meeting points of two grille bars at the periphery of the grille, and to produce crossing points of two grille bars inside said periphery, and also comprises pivotal connectors which interconnect the two adjacent grille bars at each meeting point and crossing point. Such a security grille is herein called a grille of the type described.

BRIEF DESCRIPTION OF THE PRIOR ART

Grilles of the type described are treated in, for example, British Patent Applications GB 2 224 073 A and GB 2 183 716 A.

Properly constructed, a grille of the type described depends for its smooth operation, when expanding and collapsing, on the uniformity of spacing between adjacent pivotal connectors in a given grille bar. Minute departures from such uniformity are believed to accumulate along and across the grille and give rise to jamming, jerky action, noisy operation and other defects.

The pivotal connectors are commonly rivets. Rivets are disadvantageous in that they are subject to wear and distortion, that they often produce objectionable noise when the grille is expanded and collapsed, and that those of ferrous metal are liable to corrosion. The holes drilled in the grille bars to accept the rivets must be placed with great precision if jamming or jerky action is to be avoided. Such precision is costly and difficult to achieve, and may be wasted if irregularity is reintroduced by wear, distortion or corrosion of rivets.

It is an object of the invention to overcome or substantially ameliorate at least some of the above-mentioned disadvantages. Another object is to provide a security grille which operates smoothly, silently and with a lubricated feel.

SUMMARY OF THE INVENTION

The invention accordingly provides a grille of the type described, wherein each grille bar in one of the two sets of bars has all its pivotal connectors uniformly and non-adjustably spaced apart along its length, each grille bar in the other set of bars has each of its terminal or meeting-point pivotal connectors non-adjustably and a uniformly spaced apart from its respective adjacent internal or cross-point pivotal connection, while the pivotal connectors in one of the sets of bars are fixed, and those around the periphery of the other set are also fixed; but the pivotal connectors of the central region of said other set of bars are slidably retained and displaceable along their respective grille bars to a small extent sufficient to compensate for the spacing irregularities that give rise to jamming and the other defects mentioned. Thus the grille automatically suppresses said defects in the course of expanding and collapsing, which gives a smooth movement and a lubricated feel to both procedures.

To effect uniform non-adjustable spacing of pivotal connectors, each grille bar preferably has a retaining formation into which the pivotal connectors can be inserted and so become slidably movable. A spacer rod may be provided, likewise insertable into the retaining formation and movable into abutment with the positioned pivotal connector, thus retaining the latter in its place. The pivotal connectors used at the peripheral meeting points, however, are fixed and non-displaceable, so as to prevent their escape from the ends of the grille bars.

These peripheral meeting-point pivotal linkages, or better, every second such linkage, may be provided with rollers captive within a frame of hollow guide rails for travel therein during expansion and collapse of the grille. The distance travelled may be substantial, (compared with the grille dimensions) as it is in the two guide rails which extend in the direction of grille expansion and collapse, or it may be minimal, as in the other two opposed guide rails, wherein the distance travelled by the captive rollers is limited by and to the change in the width of the grille consequent on its change in length during expansion and collapse.

In a given grille, all the spacer rods are equal in length. The spacing of pivotal connectors effected by the spacer rods is a standard distance called the pitch of the grille. It is essential that the pitch be uniform over the whole area of the grille. To produce grilles that differ from one another in pitch, spacer rods of appropriate length must be used.

Preferably the retaining formation is afforded by the cross-section of the grille bars, a desirable cross-section being C-shaped with the tips of the limbs of the C defining the edges of a slot that extends along said bar, and leads to a channel thereinside.

Preferably each pivotal connector (other than the peripheral or meeting-point ones) is dumb-bell shaped, having at each of its ends a respective head of a size to enter the channel of a grille bar from one end of said channel, but too big to escape through the aforementioned slot. At least one of the pivotal connector's heads has a circular profile to enable the pivotal connector to function as a pivot pin.

Preferably the shaft of the "dumb-bell" bears a median extension, such as a disc coaxial with said shaft, to act as a washer or spacer between the pivotally interconnected grille bars so as to prevent their abrading each other or making noise in use. For this purpose among others the pivotal connector can be of stainless steel, brass or other metal, but is preferably made of low-friction plastics material such as Nylon (TM) 6, Perlon (TM), glass-filled Nylon (TM) or the like, while the grille bar is preferably an extruded section of metal such as an aluminium alloy, which may be anodized or coated to improve its corrosion resistance.

Each peripheral or meeting-point pivotal connector may comprises a pivot pin passing through aligned bores in the ends of the grille bars, said bores being desirably lined with respective flanged sleeves, the flanges in use lying between the grille bars to prevent contact between them, in the manner of washers. Preferably every second peripheral pivotal connector is of this kind, the others being equipped with guide rollers, as will be described later. The pivot pin and sleeves are preferably made from hard-wearing plastics material, such as Nylon (TM).

A useful and economical embodiment of the invention provides a pivotal connector united with a spacer rod as an integral moulding. The pivotal connector is at one end of the spacer rod, so that the latter can be supplied longer than any foreseen grille requires, and can be simply cut at its free end to the overall length appropriate for the grille in hand.

In another useful embodiment the spacer rod, with or without a pivotal connector integrally formed on one of its ends, is adjustable in length before assembly of the grille. Preferably the spacer rod comprises two separable portions having respective complementary formations such as two arrays of teeth selectively interengageable to provide a spacer rod of a desired length. The cross-sectional dimensions of the thus length-adjusted spacer rod are such that it can enter and occupy the retaining formation (such as the C-channel) in a grille bar but once in, its parts cannot separate, as that requires relative movement of the portions transversely of the grille bar, for which movement there is insufficient room in the channel cross-section.

A useful refinement is a terminal or peripheral spacer rod which, with or without an integral pivotal connector at one of its ends, bears an abutment formation at its other end, having a housing for the roller means mentioned above. The abutment formation ensures that the terminal spacer rod, preceded by the integral pivotal connector, having entered the retaining formation of a grille bar, can penetrate thereinto to the desired distance and no further.

DETAILED DESCRIPTION OF THE INVENTION

Figure 1:
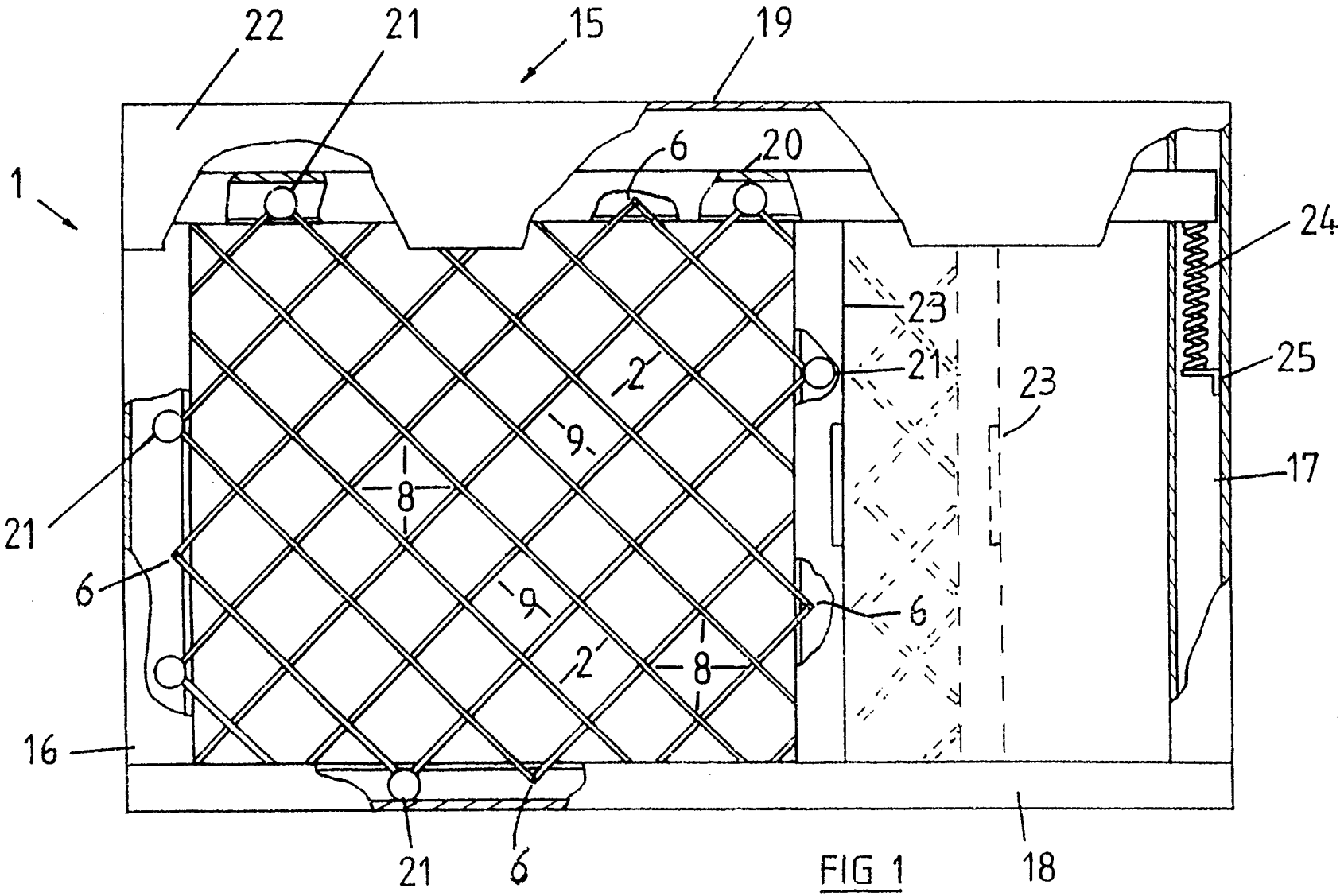
FIG. 1 is an elevation of a collapsible security grille for a counter top.

Beginning with FIG. 1, a security screen or grille 1 according to the invention comprises a grille array consisting of a first set of channelled grille bars 2 and a second, similar set of grille bars 9, similar to grille bars 2, the second set being to the rear of the first set as seen in FIG. 1.

Figure 2:
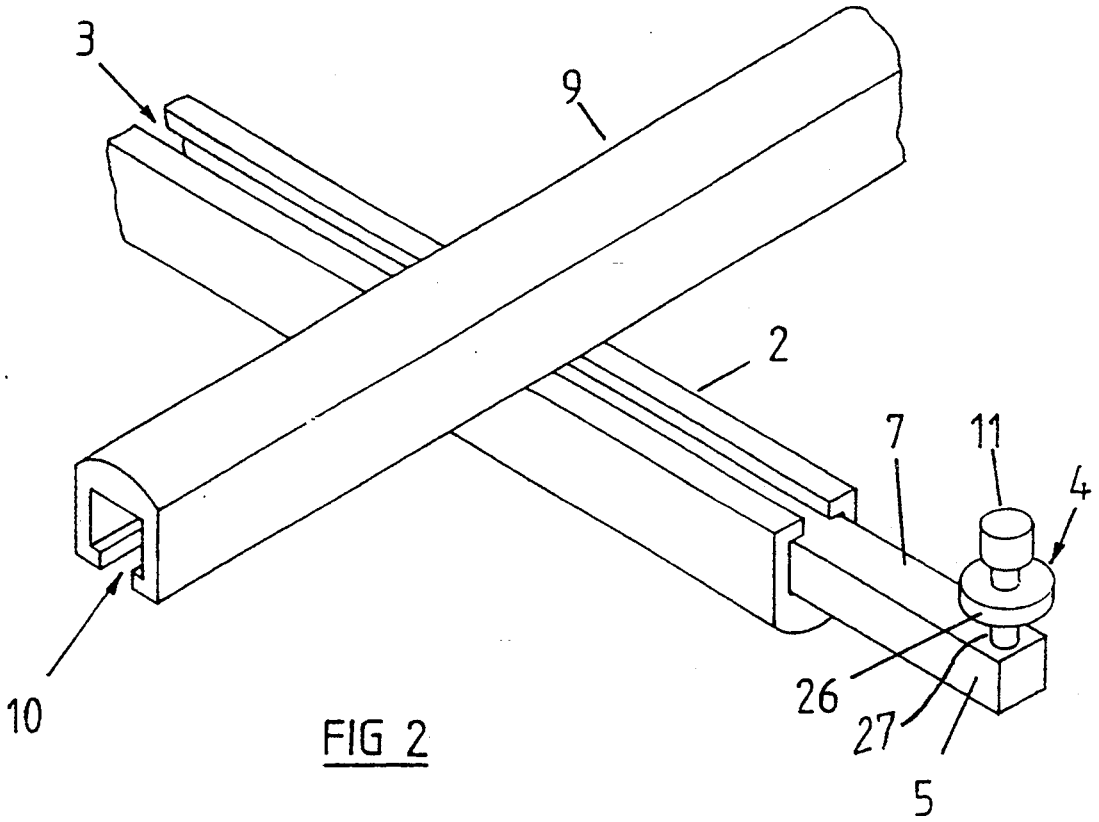
FIG. 2 is a perspective view of two lengths of grille bar from the grille of FIG. 1, arranged to form a crossing point.
Figure 3:
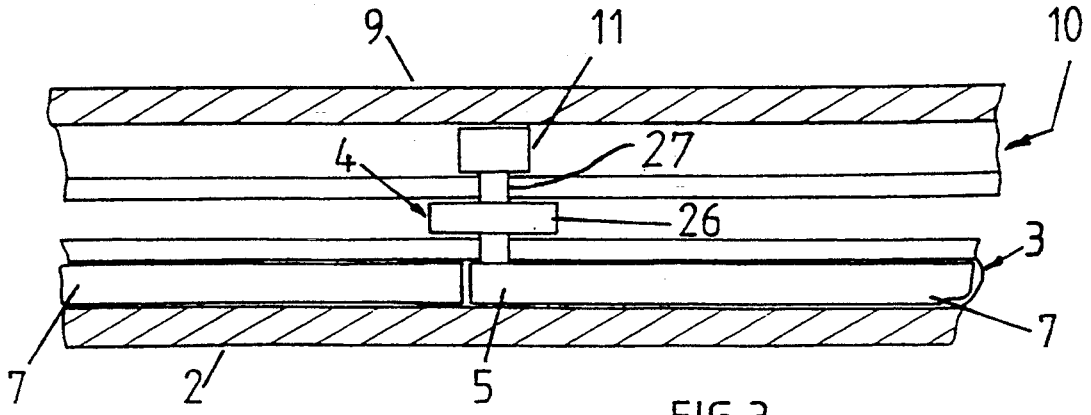
FIG. 3 shows the bar lengths of FIG. 2, pivoted into alignment and then longitudinally sectioned.

As seen in FIGS. 2 and 3, each grille bar 2 has a retaining channel 3 along its length. Each grille bar 2 captively retains in its channel 3 a plurality of pivotal connectors 4 about their respective first ends 5. Spacer rods 7, all of equal length, are disposed within channels 3 between neighboring pivotal connectors 4 to maintain said connectors in a spaced apart configuration defining intersection points 6 and 8. The second set of grille bars, namely that of grille bars 9, has respective retaining channels 10 along the length of each. The grille bars 9 of said second set are presentable into respective engagement with the complementary second ends 11 of the pivotal connectors 4 so that associated grille bars 2 and 9 are rotatably engaged at intersection points 6 and 8 and pivotally movable between an extended and a retracted configuration.

The intersection points 6 and 8 comprise meeting points 6 around the periphery of the grille 1, and crossing points 8 across the interior of said grille. Further spacer rods 7, again of length equal to that of the aforementioned spacer rods 7, are disposed within channels 10 of grille bars 9 one at either end of each of said grille bars 9, thus spacing apart each meeting point 6 and its neighbouring crossing point 8.

Figure 11:
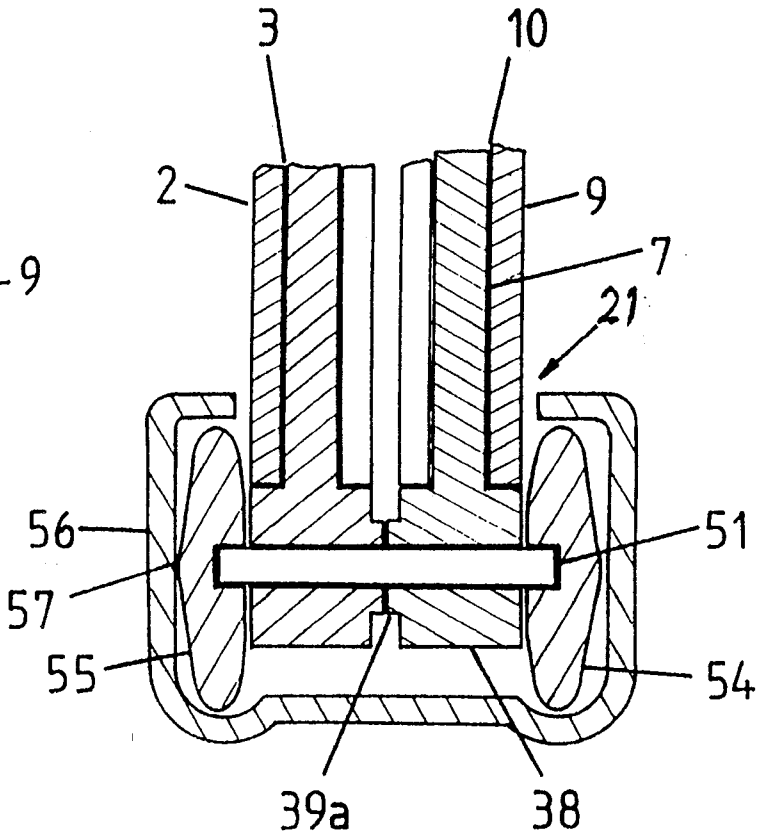
FIG. 11 is a section in end elevation of the meeting point of FIG. 10, showing in addition a channel member in which the rollers are captive.
Figure 10:
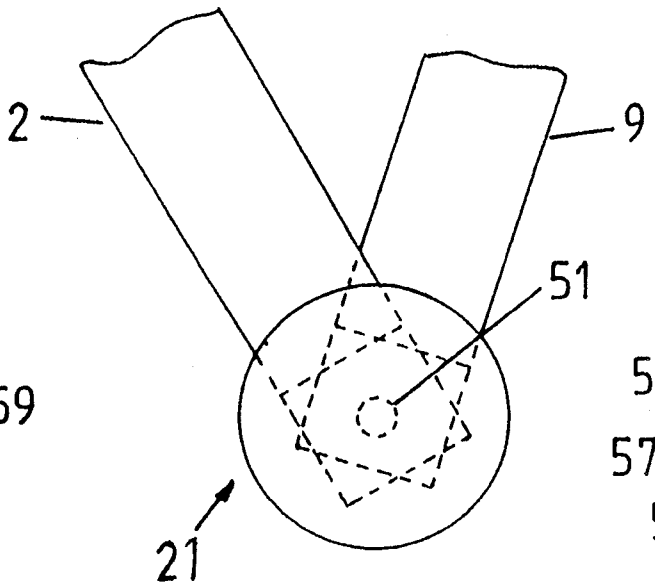
FIG. 10 is a side elevation of a meeting point of the ends of two grille bars of the type shown in FIG. 2, equipped with a pair of rollers.
Figure 12:
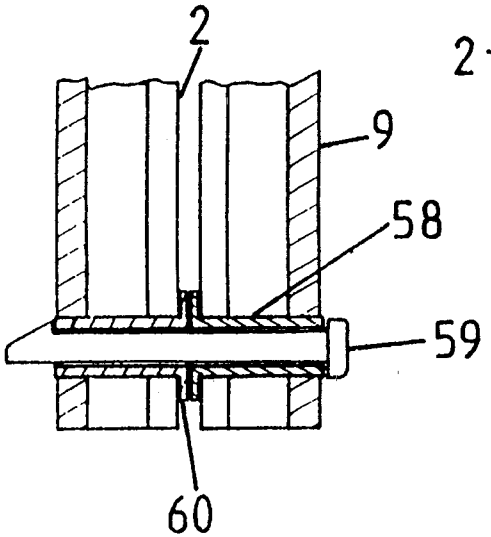
FIG. 12 is a section in end elevation of a meeting point similar to that of FIG. 10, but with a fixed pivot pin and without rollers.

As seen in FIG. 1, the grille 1 is mounted for movement within a frame 15 which is peripherally abutted about an opening across which the grille is to be extendible. The opening may be, for example, a door or a window opening. The frame 15 includes two opposed generally vertical open-channelled frame members 16, 17 joined by horizontally disposed base and top frame members 18 and 19. The top frame member 19 incorporates a downwardly extending cover 22 for accommodating alteration in the height of the grille 1 during extension and collapse thereof. As the horizontal extent, or length, of grille 1 is increased to move the channelled grille bars 2, 9 into an extended configuration, the vertical extent, or height, will decrease. The height variation is accommodated by a movable frame member 20 slidably mounted within frame members 16 and 17. The meeting points 6 of the grille bars 2 and 9 along frame members 20, 16 and 18 and a grille lead rail 23, or preferably alternate said meeting points 6 (every second one) are locations for attachment of respective carriages 21 which facilitate sliding movement of the grille within its half fixed (16, 18), half movable (20, 23) frame. The carriages 21 are best illustrated in FIGS. 10 and 11, and will be described in more detail later. The meeting points 6 not having attached carriages 21 have simple pivot pin connectors 59 (FIG. 12).

Member 20 is continually maintained in a substantially parallel attitude with respect to the base frame member 18 in order to maintain a uniform shape and size of the rhombic pattern unit of the grille 1. To achieve this effect, member 20 slidably engages members 16 and 17 and rests on compression springs 24 supported on brackets 25 within said members 16 and 17. In the extended configuration of the grille 1, movable member 20 will be adjacent to brackets 25 because the springs 24 are almost fully compressed. Alternative and preferred embodiments include only a single spring 24 and bracket 25 in one only of the frame members 16 and 17. One effect of the .spring(s) 24 is to cushion the grille approaching closure, so that a small additional manual force is necessary to close, latch or lock it.

Referring in particular to FIGS. 2 and 3, the pivotal connector 4 is dumb-bell shaped and comprises a shaft 27, end heads 5 and 11 and a central, coaxial washer member 26 for spacing the grille bars 2, 9 apart, as seen in FIG. 3. Although not appearing in the drawings as a self-contained, separate part, the pivotal connector 4 can be provided as such.

Referring to FIGS. 4 to 9, the aforesaid spacer rod 7 is presented as a two-part rod, comprising separable portions 28 or 29 and 30 or 31 adapted for interengagement to produce a spacer rod 7 of preselected length. Interengaging formations 35 and 36 preferably give a spacer bar (see FIG. 4 of mean length l 133 mm, adjustable 12 mm above and below the mean. Adjustment is effected by a movement of the separate portions 28, 31 or 29 30 transversely of their length to bring them out of engagement at a given overall length and then into engagement at a desired overall length. The formation 35 on portion 28 or 29 fits into a recess 34 in portion 31 or 30 to interengage with the formations 35, 36 so that the assembled spacer rod 7 fits the channels 3, 10 of grille bars 2, 9, and cannot be dismantled while it remains therein.

Instead of part 30, a part 31 (shown in FIG. 4) may advantageously be employed, which incorporates a pivotal connector 4 by integration with one head 5 of said connector. The length l of part 31 thus exceeds the length l of part 3 by an increment equal to that length of channel 3 which is occupied by head 5, thus determining the pitch of the grille.

Figures 4, 5, 6, 7, 8, 9:
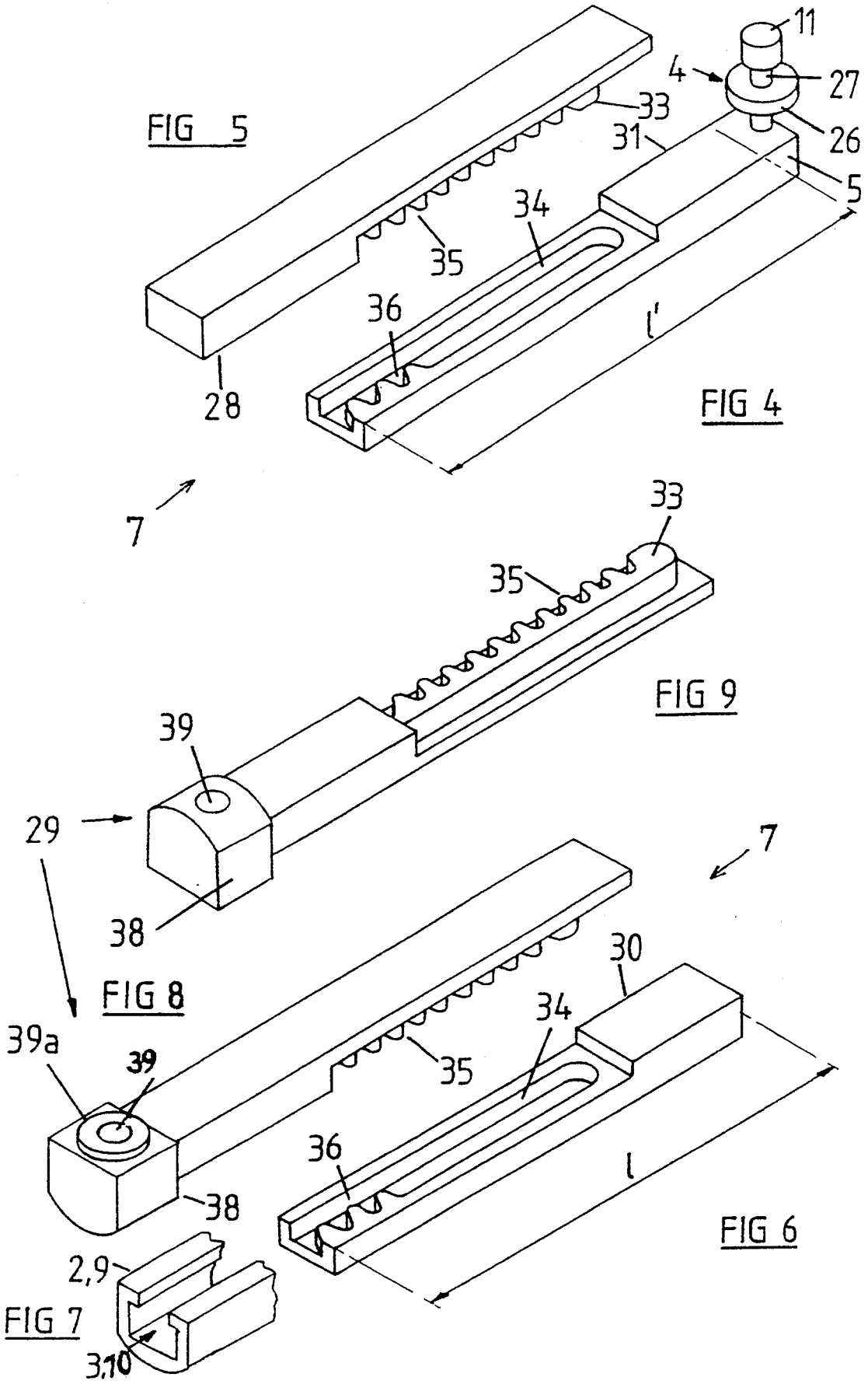
FIG. 4 is a perspective view of a first part of a two-part spacer rod with pivotal connector, for use in the grille of FIG. 1.
FIG. 5 is a perspective view of the second part of either of the two-part spacer rods, the first parts of which are shown in FIGS. 4 and 6.
FIG. 6 is a perspective view of a first part of a two-part spacer rod without a pivotal connector, for use in the grille of FIG. 1.
FIG. 7 is a perspective view of a short piece of grille bar as used in the grille of FIG. 1.
FIG. 8 is a perspective view of the second part of either of the two-part spacer rods, the first parts of which are shown in FIGS. 4 and 6.
FIG. 9 is a perspective view of the part shown in FIG. 8, taken from the other or opposite face thereof to that shown in FIG. 8.

Instead of part 28, a part 29 (shown in FIGS. 8 and 9) may usefully be employed, which bears an integral abutment formation 38, having the same cross-section as a grille bars 2 and 9. The formation 38 is perforated by a bore 39 which can serve for accommodating the pivot pin 59 shown in FIG. 12, or the roller spindle 51 shown in FIGS. 10 and 11. The formation 38 also bears an annular eminence **39*a* surrounding one end of the bore 39. As shown in FIG. 11, to assemble a peripheral or meeting-point junction of the security grille, two spacer members 7, each consisting of a part 29 and a part 31, may be inserted into the free ends of the channels 3 and 10 of grille bars 2 and 9 respectively, so that the two annular eminences 39*a* of the two parts 29 lie face to face, their height combining to equal the thickness of a washer member 26 of pivotal connector 4 (FIG. 4). A pivot pin 59 is then inserted to occupy both of the bores 39, and may have a snap-action retaining formation to secure it (FIG. 12). Alternatively a spindle 51 is inserted through the bores 39, and a pair of rollers 54, 55 is fitted to the projecting ends of the spindle (FIG. 11). This assembly produces a carriage 21 which can be captively retained in a channel rail 56, which may function as any of the frame members 16, 17, 18 or 20 (FIG. 1) aforesaid. Each of rollers 54, 55 includes on its outer face an axially extending protrusion 57 for providing a point contact with the wall of channel rail 56 in which carriage 21** is retained. Preferably, the protrusions are conical.

It is preferred that rollers 54 and 55 are maintained in rotatable mounting with spindle 51 by the sides of the channel rail 56 through which carriage 21 is to move. However, other embodiments include fixing means for ensuring the rollers remain mounted to spindle 51. For example, the spindle can include two spaced apart annular detents for snap locking engagement with respective complementary indents in rollers 54 and 55.

Conical protrusions 57 preferably have their apexes aligned with spindle 51 and are configured such that any twisting of spindle 51 during relative movement between grille bars 2 and 9 results in a larger surface area of the rollers being presented into engagement with the edges of the channel rail 56. This has the effect of allowing a small degree of twisting of spindle 51 to facilitate movement of the grille, while preventing any jamming of the rollers in the channel.

For openings of non-standard sizes the length of the grille bars 2 and 9 and the spacing between intersection points can be adjusted to ensure an appropriate sizing of the grille in the extended configuration. The spacing adjustment can be achieved by:

(a) producing specialized spacer bars 7 for each particular application;

(b) producing a standard length of spacer bar 7 which is then cut to size; or (c) using the spacer bar variations as illustrated in FIGS. 4–9 and appropriately adjusting the portions to produce a bar of desired length.

Figure 13:
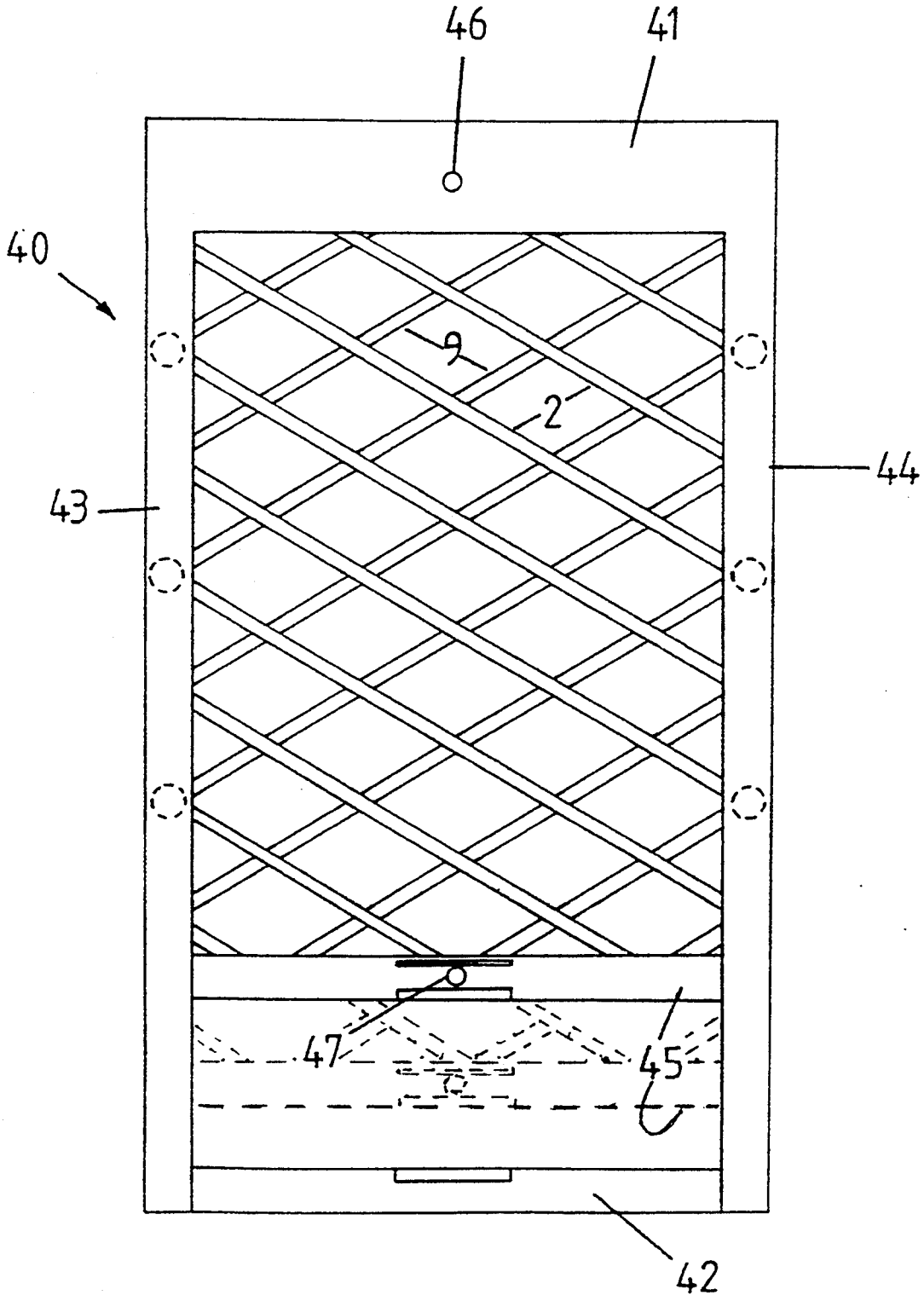
FIG. 13 is an elevation of a collapsible security grille for an upright window reveal.

Referring to FIG. 13, a variant of the security grille 1 of FIG. 1 is shown. The grille 40 contains adjustable spacer bars as described in connection with FIGS. 4–9. The outer, non-collapsible frame consists of frame members 41, 42, 43, 44 and the screen, made up of screen bars 2, 9, has a leading edge held by a movable rail 45. A rivet 46 anchors a median, peripheral, screen bar meeting point within the top frame member 41. A second rivet 47 anchors a median, peripheral screen bar meeting point within the movable rail 45. The effect of the rivets 46, 47 is to centralize the screen 40, impose bilateral symmetry on it, and thereby further improve the smooth and fluent expansion and collapse of the screen in use, in addition to the qualities of operation and feel imparted by the embodiment shown in FIG. 1.

Although the invention has been described with reference to specific examples, it will be appreciated by those skilled in the art that it may be embodied in many other forms. For example, an electric motor or other apparatus can be used to assist in moving the grille between the extended and retracted configurations. Furthermore, some embodiments include an integral fly screen which collapses when the grille is retracted and which may be constructed, for example, like a conventional roller blind. Such a fly screen may be completely enclosed within, for example, frame member 16 when in that collapsed configuration.

I claim:

1. In a collapsible security grille comprising (a) a frame, (b) a grille array supported in said frame comprising two sets of rigid elongate parallel spaced-apart grille bars, said two sets being disposed with respect to each other so as to meet at the periphery of said frame and so as to meet and cross each other within the periphery of said frame, and (c) spaced-apart pivotal connectors pivotally connecting said two sets at those points where they meet and cross each other, the improvement comprising (d) said two sets of said grille bars each having a retainer channel for receiving said spaced-apart pivotal connectors, said retainer channels including flanges for slidably retaining said spaced-apart pivotal connectors between said two sets of grille bars at those points where they meet and cross each another.

2. The grille of claim 1 including spacer rods insertable and positionable within said retainer channels for positioning said spaced-apart pivotal connectors that are located within said periphery.

3. The grille of claim 1 wherein said retainer channels have substantially C-shaped cross-sections.

4. The grille of claim 3 wherein said spaced-apart pivotal connectors that are located within said periphery are dumbbell-shaped and are retained within said retainer channels.

5. The grille of claim 4 wherein said spaced-apart pivotal connectors have means to prevent contact between crossing grille bars.

6. The grille of claim 2 wherein at least some of said spacer rods are integral with said spaced-apart pivotal connectors within said periphery.

7. The grille of claim 2 wherein at least some of said spacer rods have terminal abutment formations restricting their depth of insertion into said retainer channels.

8. The grille of claim 2 wherein at least some of said spacer rods comprise two separable portions adapted for interengagement.

* * * * *

UNITED STATES PATENT AND TRADEMARK OFFICE

CERTIFICATE OF CORRECTION

PATENT NO. : 5,437,134

DATED : August 1, 1995

INVENTOR(S) : Francis Martin Donnelly

It is certified that error appears in the above-indentified patent and that said Letters Patent is hereby corrected as shown below:

In the Abstract, line 6: after "one" insert -- of --.

Column 2, line 4: after "effect" insert -- this --.

Column 2, line 61: delete "comprises" insert -- comprise --.

Column 5, line 6: delete "." before "spring(s)".

Column 5, line 21: after "FIG. 4" insert -- ) --.

Column 5, line 43: delete "a" before "grille".

Signed and Sealed this

Twenty-ninth Day of April, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT : 5,437,134

DATED : August 1, 1995

INVENTOR(S) : Francis Martin Donnelly

It is certified that error appears in the above-identified patent and that said Letters Patent is hereby corrected as shown below:

On the title page, item [76] Inventor: please change the inventor's address to read as follows:

-- Valleymount, Blessington, County Wicklow, Ireland--.

Signed and Sealed this

Sixteenth Day of December, 1997

*Attest:*

Bruce Lehman

BRUCE LEHMAN

*Attesting Officer*

*Commissioner of Patents and Trademarks*